US009108330B2

(12) United States Patent
Koch

(10) Patent No.: US 9,108,330 B2
(45) Date of Patent: Aug. 18, 2015

(54) DISC CUTTING MACHINE HAVING A CANTILEVERED DRIVE HOUSING AND ACCESSORY UNIT

(75) Inventor: Nikolaus Koch, Geislingen (DE)

(73) Assignee: Bizerba GmbH & Co. KG, Balingen (DE)

( * ) Notice: Subject to any disclaimer, the term of this patent is extended or adjusted under 35 U.S.C. 154(b) by 492 days.

(21) Appl. No.: 13/518,541

(22) PCT Filed: Dec. 13, 2010

(86) PCT No.: PCT/EP2010/007576

§ 371 (c)(1),
(2), (4) Date: Jun. 22, 2012

(87) PCT Pub. No.: WO2011/076351

PCT Pub. Date: Jun. 30, 2011

(65) Prior Publication Data

US 2012/0255408 A1 Oct. 11, 2012

(30) Foreign Application Priority Data

Dec. 24, 2009 (DE) ..... 10 2009 060 465

(51) Int. Cl.

| | |
|---|---|
| ***B26D 7/00*** | (2006.01) |
| ***B26D 7/06*** | (2006.01) |
| ***B26D 7/32*** | (2006.01) |
| ***B26D 7/27*** | (2006.01) |
| *B26D 1/143* | (2006.01) |
| *B26D 7/10* | (2006.01) |

(52) U.S. Cl.

CPC ..... *B26D 7/00* (2013.01); *B26D 7/0625* (2013.01); *B26D 7/27* (2013.01); *B26D 7/32* (2013.01); *B26D 1/143* (2013.01); *B26D 7/0616* (2013.01); *B26D 7/10* (2013.01); *B26D 2210/02* (2013.01); *Y10T 83/2181* (2015.04); *Y10T 83/222* (2015.04); *Y10T 83/293* (2015.04); *Y10T 83/7793* (2015.04)

(58) Field of Classification Search

CPC ..... B26D 7/00; B26D 7/32; B26D 1/143; B26D 2210/02; B26D 7/27; B26D 7/0625; B26D 7/0616; B26D 7/10; B26D 5/20

USPC ..... 83/150, 491, 167, 171, 713, 474, 62.1, 83/522.13, 29, 23, 94, 932, 155.1, 96, 83/707; 99/537

See application file for complete search history.

(56) References Cited

U.S. PATENT DOCUMENTS

| | | | | | |
|---|---|---|---|---|---|
| 1,976,865 | A | * | 10/1934 | Van Berkel | 83/96 |
| 1,993,586 | A | * | 3/1935 | Bech | 83/88 |
| 2,013,054 | A | * | 9/1935 | Kallos | 83/112 |
| 2,095,043 | A | * | 10/1937 | Van Berkel | 83/94 |
| 2,274,626 | A | * | 2/1942 | Van Berkel | 83/96 |
| 2,783,805 | A | * | 3/1957 | Wielechowski | 83/94 |
| 4,338,836 | A | * | 7/1982 | Kuchler | 83/94 |
| 6,279,302 | B1 | * | 8/2001 | Kuchler | 53/517 |

* cited by examiner

*Primary Examiner* — Ghassem Alie
(74) *Attorney, Agent, or Firm* — Hackler Daghighian & Martino

(57) ABSTRACT

An electrically operated disc cutting machine for cutting discs from strand-shaped cutting goods includes a cutting unit which has a circular blade mounted in a rotatable manner in a drive housing, an electric motor surrounded by the drive housing, and a base plate on which the drive housing is installed in a cantilevered manner via at least one support column extending in the vertical direction. The support column in the horizontal direction remains open in which at least one accessory unit for the further processing of cut cutting goods is arranged. In this way, a conventional disc cutting machine can be improved in a cost effective manner and using simple technical means to the effect that the machine has a particularly compact design and can be easily converted to different operating modes, wherein accessory units necessary therefor can be stored in the same housing as the drive.

19 Claims, 8 Drawing Sheets

DISC CUTTING MACHINE HAVING A CANTILEVERED DRIVE HOUSING AND ACCESSORY UNIT

The invention relates to an electrically operated disc cutting machine for cutting disks especially from strand-shaped cutting goods, preferably foodstuffs, having a cutting unit which comprises a circular blade mounted in a rotatable manner in a drive housing, with an electric motor surrounded by the drive housing to drive the cutting unit, as well as with a base plate on which the drive housing is installed in a cantilevered manner via at least one support column extended in the vertical direction.

Such disk cutting machines are known, for example, from DE 103 17 319 A1.

The cutting goods, especially in automatically operated disk cutting machines for strand-shaped foodstuffs such as sausage, hams, salmon, cheese, etc. are moved aided by a delivery mechanism on a delivery belt toward the cutting device, mostly in a direction perpendicular to the cutting plane, in which customarily one or more rotating blades turn, to cut discs from the delivered cutting goods. The cutting unit is driven by an electric motor, which is fully enclosed by a machine housing to protect against water sprays and contamination as well as to be mechanically secure against external encroachment.

A sectional cutting machine with a multiplicity of cutting units placed next to each other, beneath which a conveyor belt is provided to carry away the cut-off disks of cutting goods, is described in AT 385939 B.

In the disk cutting machine according to DE 103 17 319 A1 cited initially, the space which is opened above the base plate by the support column is totally unused, thus unnecessarily increasing the structural height of the disc cutting machine.

SUMMARY OF THE INVENTION

In contrast, the task of the present invention is to improve a generic disk cutting machine of the type described initially in cost-effective fashion and with simple technical means, so that the machine is configured to be as compact as possible and make possible easy conversion to various operational modes, wherein the accessory units necessary for this should all be able to be accommodated in the same housing as the drive.

According to the invention, this problem is solved in a surprisingly simple and effective way in that the support column is so configured that beneath the cutting unit, between the drive housing and the base plate, a continuous intermediate space in the horizontal direction remains open, in which at least one accessory unit for further processing of cut cutting goods is placed, and that a connection of the accessory unit is accommodated in the drive housing.

In this way a defined, continuous spatial area above the base plate is opened which, through placement of accessory units, whose attachments are provided so as to be coverable in the drive housing, can be meaningfully exploited, thus making the invention-specific disc cutting machine more compact and versatile in configuration. The attachments in the drive housing make possible rapid and problem-free replacement of various accessory units, so that the disk cutting machine can easily be converted and thus offering high flexibility in regard to various operational modes as well as simplified maintenance and cleaning of the parts used.

In one simple embodiment form of the invention-specific disc cutting machine, only one support column extending vertically is provided, which forms an L-shape with the base plate. Thus the full width of the machine housing can be used for the accessory unit(s), so that a maximum of usable space is available between the base plate and the drive housing.

Alternatively, in another preferred embodiment form of the invention, two (or even more) support columns extending vertically are placed next to each other horizontally, which increases the mechanical stability of the structure.

Especially preferred are embodiment forms of the invention-specific disc cutting machine in which at least one support column exhibits at least one mechanical attachment for reversible assembly of an accessory unit, so that not only the drive housing, but also the support columns are used for attachments, to further increase the variability of the invention-specific disc cutting machine while simultaneously having a high degree of compactness.

In advantageous additional forms of these embodiments, coverings can be provided for dust-free sealing of mechanical attachments not used in the support column.

Embodiment forms of the invention can be made even more compact in which electronic control elements can be accommodated in the drive housing for automatic operation of the disc cutting machine and/or electrical or mechanical operating elements.

In one class of embodiment forms of the invention-specific disk cutting machine, an accessory unit comprises a foil roll, from which foil can be guided to receive cut cutting goods in the intermediate space between the drive housing and the base plate, wherein preferably a pivot bearing of the foil roll is provided in one of the support columns. In this way, the cutting goods fall directly onto the packaging foil and thus can be further processed in a particularly hygienic manner.

Advantageous further developments in this class of embodiment forms are characterized in that on the support column or outside on the drive housing, a cutting unit is placed for cutting foil pieces, or a tear-off edge for tearing of foil pieces, to result in a packaging size—also variable in various operational states—for a desired number of disks for cutting goods.

Alternatively or additionally, in another class of embodiment forms, an accessory unit can be provided that comprises a conveyor belt for transport of cut disks of cutting goods through the intermediate space between the drive housing and the base place, wherein the drive unit for the conveyor belt is accommodated in the drive housing, so that the unit may be configured to be especially compact. Thus the entire conveyor belt mechanism, including the belt drive, can be accommodated in that same motor housing as for the drive of the disk cutting machine itself.

Another class of embodiment forms of the invention is characterized in that, alternatively or in supplemental fashion, an accessory unit comprises a bent, preferably driven storage table, especially one L-shaped, for receiving cut discs of cutting goods in the intermediate space between the drive housing and the base plate, wherein a drive mechanism is accommodated if necessary for the storage table in the drive housing.

In a preferred and easy-to-manufacture further development of these embodiment forms, in or on the storage table a toothed strip is placed, which engages with a toothed wheel, driven if necessary by its own motor.

An embodiment form of the invention-specific disk cutting machine that takes up an unusually small space is one in which a drive mechanism is accommodated for driving at least one accessory unit in the drive housing.

Especially with further developments of these embodiment forms, a drive mechanism can be accommodated in the drive housing to drive a chopper for cut disks of cutting goods.

Preferably with especially compact further developments, even all of the drive mechanisms for driving all of the accessory units are accommodated in the drive housing.

By having the drive motor of the disk cutting machine fully enclosed as a rule by the machine housing, waste heat generated builds up inside the machine housing. A problem arises mainly in machines that run continuously for lengthy periods, whose electric motors are not switched off when no disks are cut from the cutting goods, in that there is a danger that sensitive parts of the device will overheat. To at least partially expel this waste heat outwards, with especially preferred embodiment forms of the invention, a ventilation device is provided, by means of which at least during operation of the disk cutting machine a cooling air flow can be generated that is guided through an inlet opening into the drive housing, to the electric motor, past it, and then exits through an outlet opening. Such ventilation devices are known per se from EP 0 115 788 A1, for example.

Especially simple and compact further developments of these embodiment forms of the invention-specific disc cutting machine are characterized in that the ventilation device is placed in one of the support columns and forms a coolant air channel through which the cooling air is guided to an outlet below the drive mechanism.

True, on the one hand, many ventilation devices previously known have been relatively expensive to assemble and on the other hand do not allow the disc cutting machine to be simply and thoroughly cleaned by water sprays even when the electric motor is switched off, because excessively large inlet and outlet openings permit water sprays to enter the interior of the machine housing and thus could result in damage to the electric motor. To avoid such water damage, as well as for hygienic reasons, only relatively small ventilations slits are provided in many of the known ventilation devices, in addition with a sealing labyrinth as a rule adjoining within the machine housing, before the inlet air gets to the electric motor and the outlet air goes outward from there again. Also, often a fan wheel is provided which generates a pressure gradient and thus an air flow through the channels of the ventilation device. Nonetheless, on the market hardly any disc cutting machines can be found whose housings can be sprayed off when not in an operational state.

So that at least when not in an operational state, the invention-specific disk cutting machine can easily be cleaned by water spraying, but where also during operation it is ensured that sufficient waste heat from the electric motor is expelled, with advantageous further formations of the embodiment forms described above, provision is made that the ventilation device comprises a locking device, which, when the electric motor is switched off, closes the outlet opening of the ventilation device to be impervious to water sprays, but in contrast when the electric motor is switched on, keeps it open for exiting cooling air flow, with the activation of the locking mechanism coupled to activation of an on-off switch. Thus, in an elegant way, two requirements for industrial disc cutting machines that are diametrically opposed to each other are simultaneously met, namely on the one hand to ensure good cooling of the electric motor and temperature-sensitive electronic equipment, and on the other hand sufficient sealing of the machine housing against water sprays, so that the disc cutting machine can be easily but thoroughly cleaned by simple spraying with a water stream, which is an important requirement for processing foodstuffs for hygienic reasons.

A further advantage of the proposed invention-specific measures is that through linking of the locking mechanism to an on-off switch, it is always ensured that even without action by operating personnel, when the electric motor is turned on, a sufficient flow of cooling air gets into the machine housing, while with the electric motor switched off, the machine housing is automatically closed to seal against water sprays.

Lastly, one especially advantageous further development of the above embodiment forms is characterized in that the ventilation device is geometrically configured so that the cooling air flow moves in the machine housing from below upwards, preferably with the outlet opening placed above the inlet opening. When the disk cutting machine is used in a foodstuffs business, in this way, cooled air can be taken in from a cooler placed below the cutting plane, and expelled upward into the surroundings. In many disc cutting machines with ventilation devices according to prior art, in other respects, in contrast to this, the contaminated and heated waste air is precisely expelled downwards, which has a negative effect in a technical and a hygienic sense on the cutting goods that mostly are stacked in a storage area below the disk cutting machine as well as on the operation of a cooler placed below there. But with known disc cutting machines this arrangement is necessary, because for hygienic reasons a smooth surface is required for easier cleaning of the surfaces that especially are contaminated during operation. However, ventilation slits would interrupt this smooth surface.

Further features and advantages are drawn from the following detailed specification of embodiment examples of the invention, using the figures of the drawings, which show particulars essential to the invention, as well as from the claims. The individual features can be implemented individually or multiply in any combinations with variants of the invention.

BRIEF DESCRIPTION OF THE DRAWINGS

In the schematic drawings, embodiment examples of the invention are depicted, which are explained in greater detail in the specification that follows.

Shown are.

DETAILED DESCRIPTION

Figure 1A:
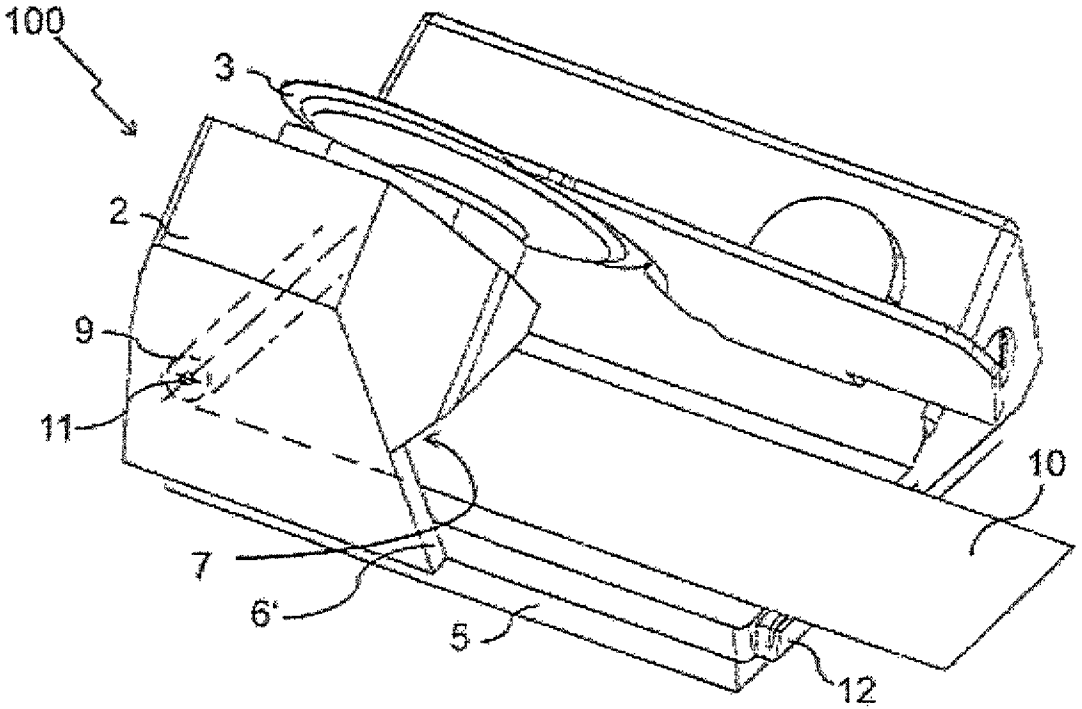
FIG. 1*a*: a three-dimensional view of an embodiment example of the invention-specific disc cutting machine with a foil roll to receive cut cutting goods

In FIGS. 1*b*, 2*a*, 3, 4*a*, 5 and 6*a* embodiment forms are depicted in schematic vertical cross sections of an invention-specific, electrically operated, preferably automatic disc cutting machine 100; 200; 300; 400; 500; 600. Each of these exhibits a drive housing 2 and a cutting device, which comprises a planar circular blade 3 supported so as to rotate in drive housing 2 with a circular rotating cutting blade. Completely enclosed by drive housing 2 is an electric motor 4*a* to drive the cutting device, which drives the circular blade 3 by a drive belt 4*b*. The drive housing 2 is installed in cantilevered fashion on at least one support column 6' extending vertically. Alternatively, the invention-specific disc cutting machine 1 can also comprise a second support column 6". Below the cutting device, between a base plate 5 and drive housing 2, an intermediate space 7 remains free, in which at least one accessory unit is placed for further processing of cut cutting goods 23 (see FIGS. 5, 6*a* and 6*b*). The functions of the disc cutting machine and of the accessory units can be controlled by electronic operating elements 8.1; 8.2; 8.3; 8.4. In addition, a ventilation device is provided, by means of which at least during operation of disc cutting machine 1 a cooling air flow can be generated that enters into drive housing 2 through an inlet opening, is directed to electric motor 4*a*, passes by it, and then emerges again from the drive housing through an outlet opening.

If easily implemented technically, the ventilation device, for hygienic reasons, is so configured geometrically that the cooling air flow in drive housing 2 flows from the bottom upwards, preferably with the outlet opening placed above the inlet opening. True, other geometric configurations of the invention-specific disc cutting machine are possible, if this should prove necessary for other reasons.

According to the invention, the ventilation device comprises a locking device which, when the electric motor 4*a* is shut off, closes the outlet opening of the ventilation device to be sealed at least against water sprays, while when electric motor 4*a* is switched on, it keeps it open for the exiting cooling air flow, with operation of the locking device linked to operation of the electric motor.

FIG. 1*a* is a three-dimensional depiction of an embodiment example of the invention-specific disc cutting machine 100, in which the accessory unit consists of a foil 10 rolled up onto a foil roll 9. For foil roll 9, a pivot bearing 11 is provided. The foil 10 can be torn off at the front end of the disc cutting machine 100 at a tearing edge 12, for example after the cut cutting goods 23 (see FIGS. 6 and 8) have been wrapped in the foil 10.

Figures 1B, 1C:
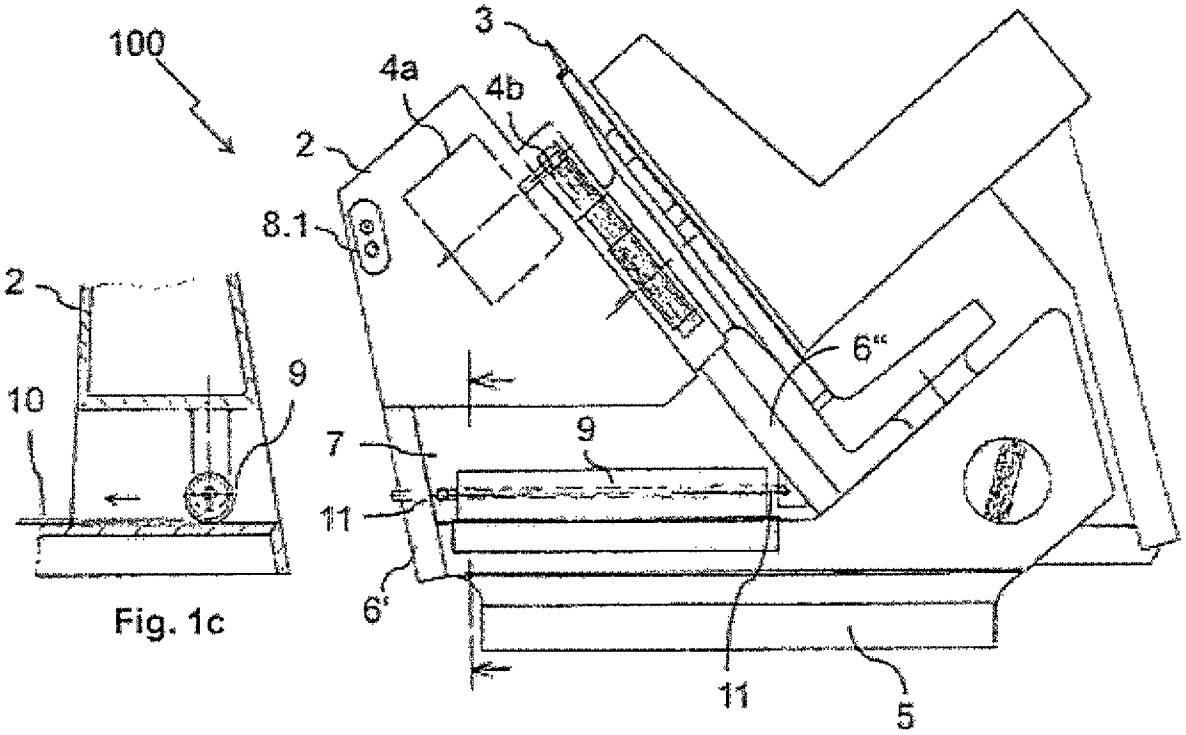
FIG. 1*b*: a schematic vertical cross section through an embodiment form according to FIG. 1*a*, as viewed from the front
FIG. 1*c*: a cross section of a schematic vertical section through the embodiment form according to FIG. 1*a*, as seen from the side

FIG. 1*b* shows the embodiment form from FIG. 1*a* again in a schematic vertical cross section, seen from the front.

FIG. 1*c* shows in a schematic vertical cross section a section of the embodiment form from FIG. 1*a*, seen from the side.

Figures 2A, 2B:
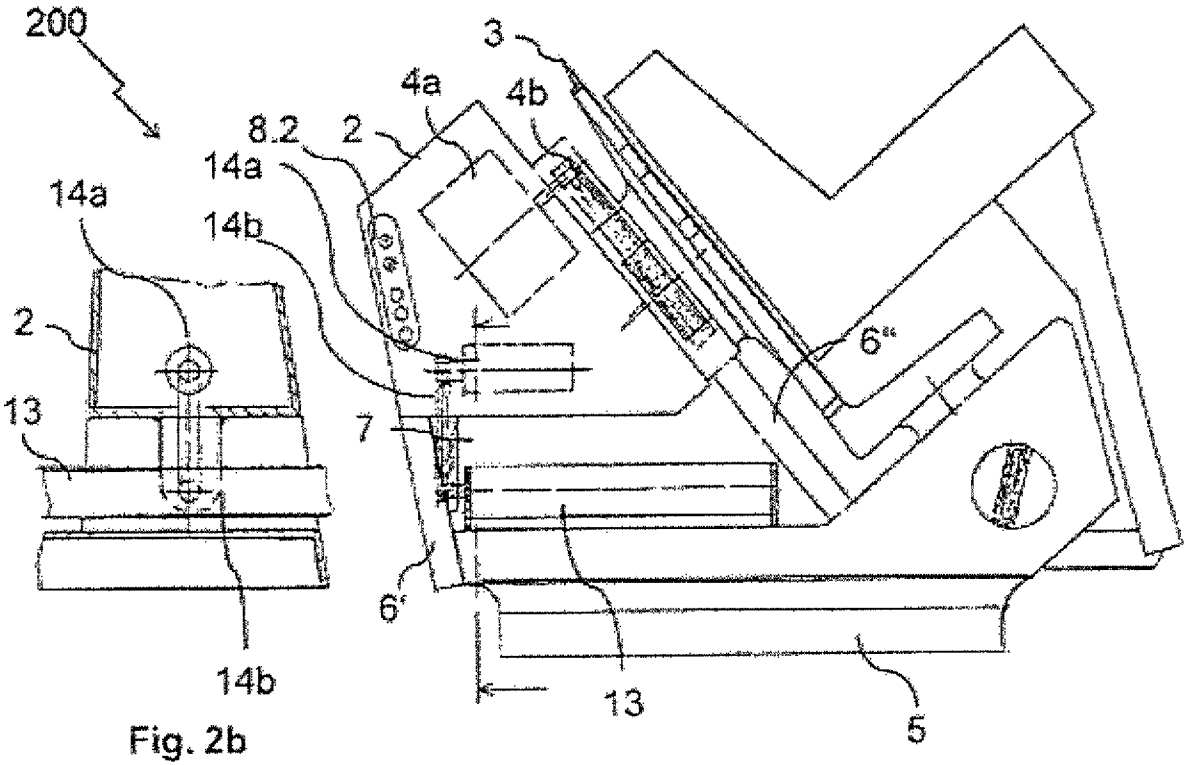
FIG. 2*a*: a schematic vertical cross section through another embodiment form with slanted circular blades as well as with a conveyor belt for takeup of cut cutting goods, viewed from the front
FIG. 2*b*: a cross section of a schematic vertical cross section through the embodiment form according to FIG. 3*a*, as viewed from the side FIG. 3 a schematic vertical cross section through an alternative embodiment belt for takeup of cut cutting goods, viewed from the front, in which the circular blade is vertical FIG. 4*a* a schematic vertical cross section through another embodiment form of the invention-specific disc cutting machine with slanted circular blade as well as with a driven storage table for takeup of cut cutting goods, viewed from the front FIG. 4*b* a cross section of a schematic vertical cross section through the embodiment form according to FIG. 5*a* as viewed from the side FIG. 5 a schematic vertical cross section through another embodiment form of the invention-specific disc cutting machine with a chain belt for lifting cut cutting goods off the circular blade, a chopper for separating the cutting goods from the chain belt and a driven storage table to receive the cutting goods, as viewed from the side FIG. 6*a* a schematic vertical cross section through an alternative embodiment form according to FIG. 5, with a conveyor belt for receipt of the cutting goods, as viewed from the side FIG. 6*b* like FIG. 6*a*, but viewed from the front.

Another embodiment example is shown in the schematic vertical cross section in FIG. 2*a*. Here in intermediate space 7 a conveyor belt 13 is placed to take up the cut cutting goods. A motor 14*a*, which drives conveyor belt 13 via a drive belt 14*b*, is accommodated in drive housing 2.

FIG. 2*b* in a schematic vertical cross section shows a section of the embodiment form from FIG. 2*a* as seen from the side.

Figure 3:
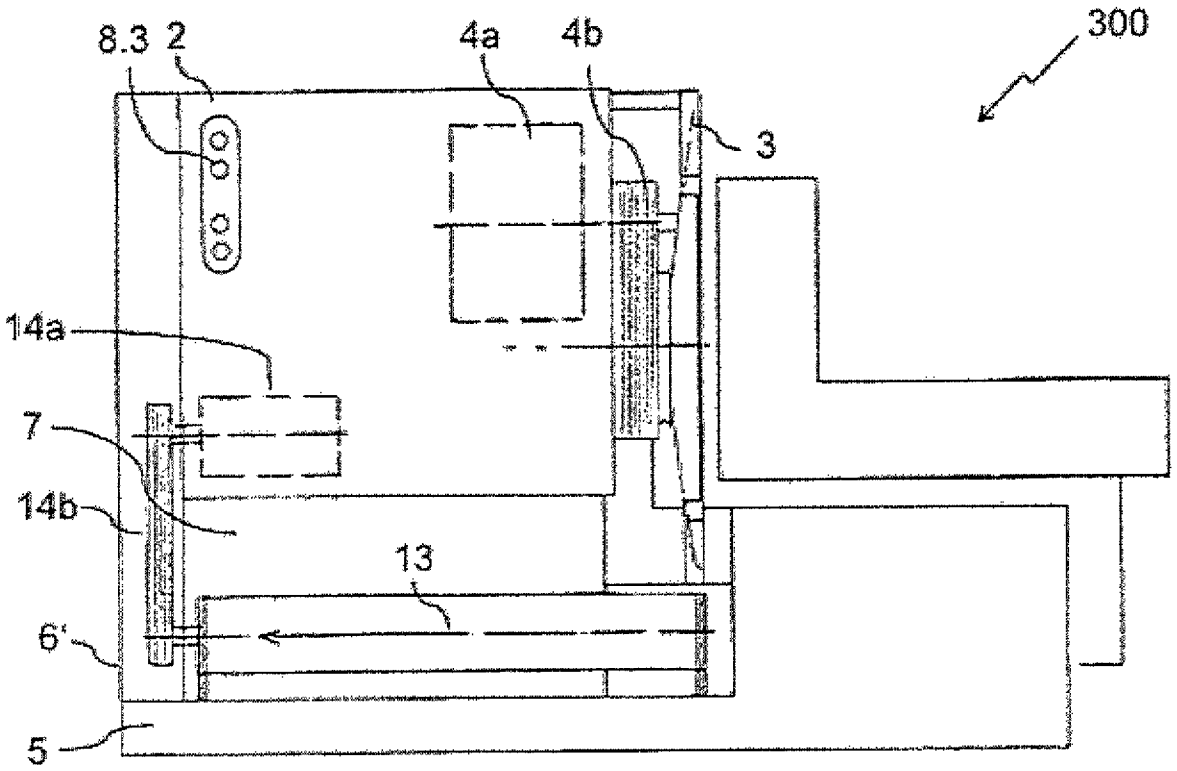

An alternative version of the embodiment form from FIG. 2*a* is shown in FIG. 3. Here the cutting device with the circular blade 3 is placed vertically, instead of at an angle as in FIG. 2*a*.

Figures 4A, 4B:
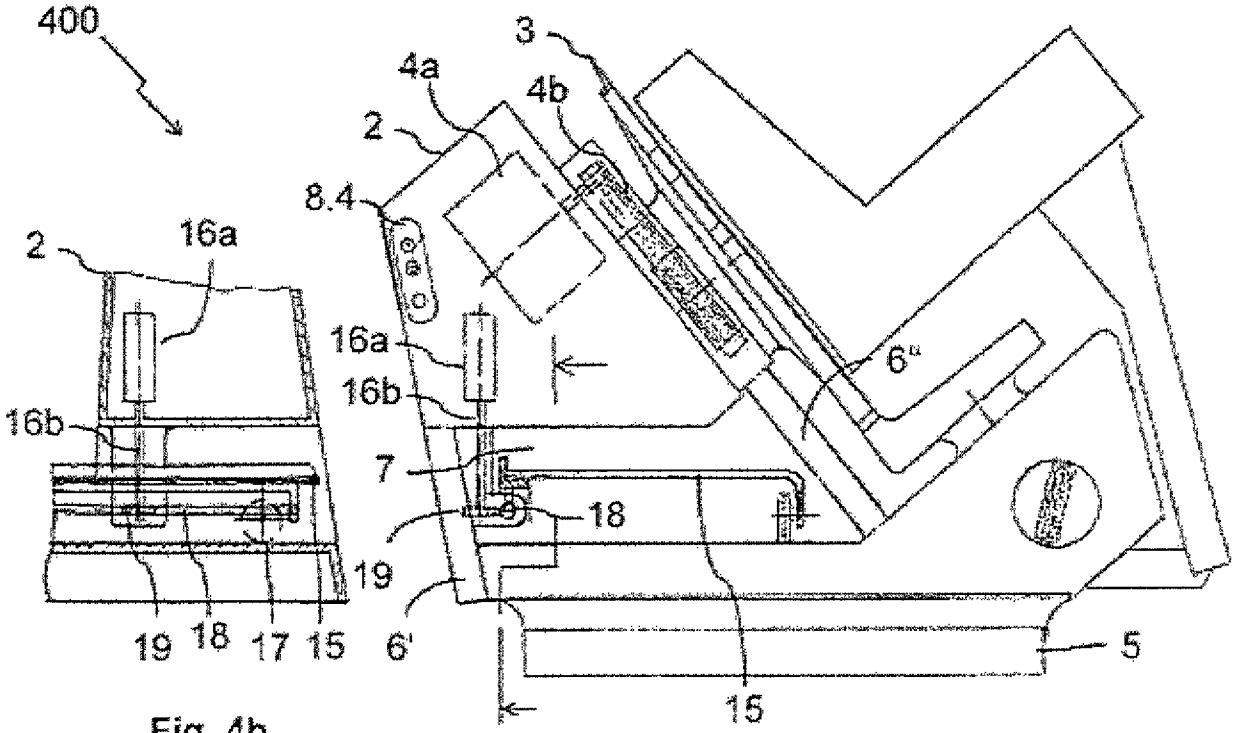

A further embodiment example is shown in FIG. 4*a* in a schematic vertical cross section, seen from the front. Here in the intermediate space 7 a storage table 15 is placed to take up the cut cutting goods 23. A motor 16*a* uses a driving linkage 16*b* to drive a toothed wheel 19, which engages with a toothed strip 18 attached to storage table 15.

FIG. 4*b* in a schematic vertical cross section shows a section of the embodiment form from FIG. 5*a* as seen from the side. In this view, the roller 17 is seen that is movably supported on storage table 15.

Figure 5:
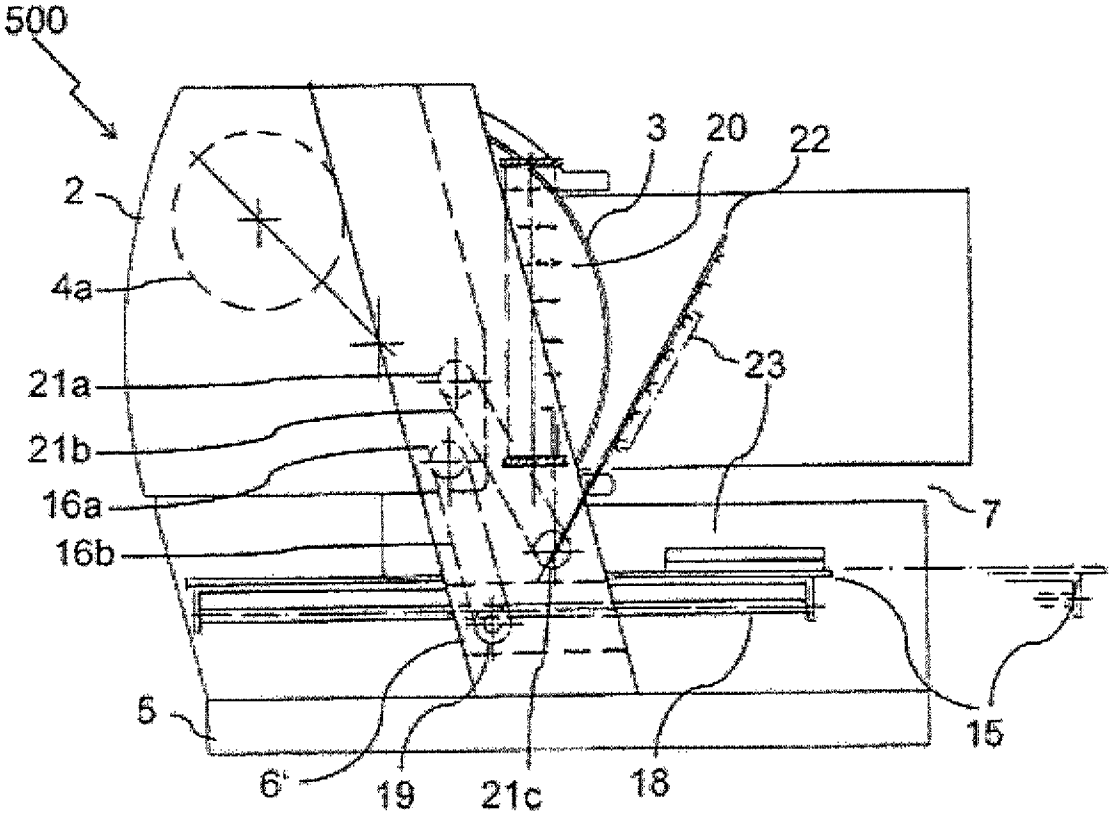

FIG. 5 shows in a schematic vertical cross section from the side another embodiment example of the invention-specific disc cutting machine 500. The cut cutting goods 23 are transported by a chain belt 20, on which hooks, cogs or spikes are placed, away from the cutting device. A motor 21*a* rotates a chopper 22 via a drive belt 21*b* about a rotational axis 21*c*, which separates the cutting goods 23 from chain belt 20. The cutting goods 23 fall from chopper 22 onto an accessory unit, which is configured in the embodiment example shown in FIG. 5 as a storage table 15.

Figure 6A:
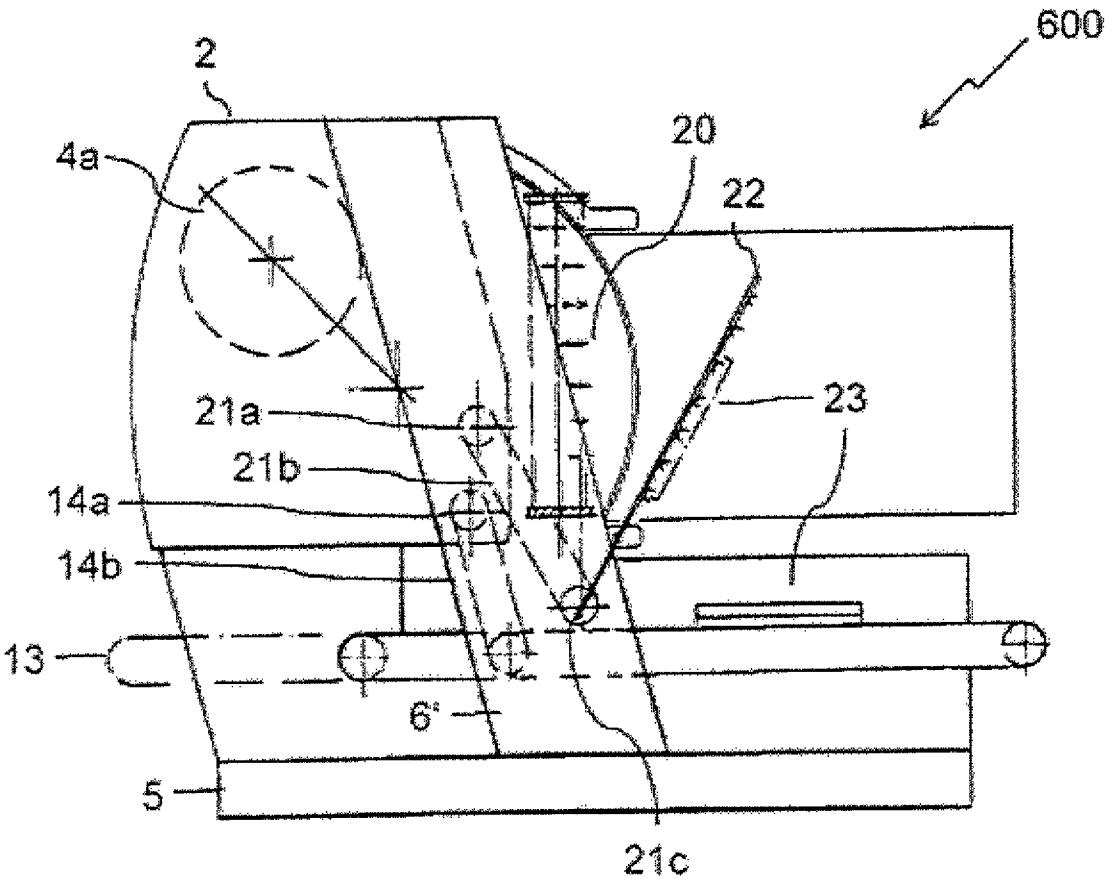

Lastly, FIG. 6*a* shows an alternative to the embodiment example shown in FIG. 5, in which a conveyor belt 13 is placed in intermediate space 7 instead of a storage table 15.

Figure 6B:
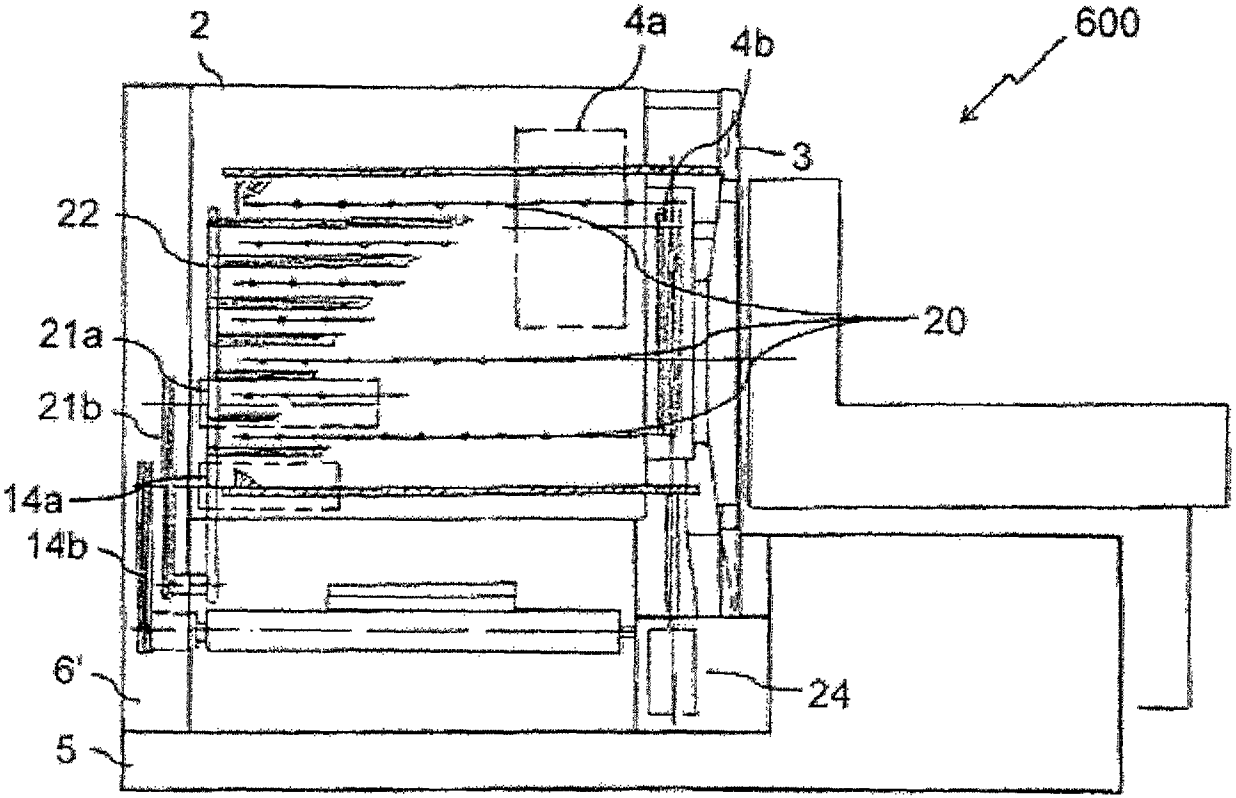

FIG. 6*b* shows in a schematic vertical cross section the embodiment form from FIG. 6*a* as seen from the front. The chain belt 20 which transports the cutting goods 23 away from the cutting device is also shown schematically. Chain belt 20 is driven by another motor 24. The chopper 22 is here seen from the front.

List of Reference Symbols

| | |
|---|---|
| 100 | Cutting machine |
| 200 | Cutting machine |
| 300 | Cutting machine |
| 400 | Cutting machine |
| 500 | Cutting machine |
| 600 | Cutting machine |
| 2 | Drive housing |
| 3 | Circular blade |
| 4a | Electric motor for 3 |
| 4b | Drive belt for 3 |
| 5 | Base plate |
| 6' | Support column |
| 6" | Second support column |
| 7 | Intermediate space |
| 8.1 | Control element |
| 8.2 | Control element |
| 8.3 | Control element |
| 8.4 | Control element |
| 9 | Foil roll |
| 10 | Foil |
| 11 | Pivot bearing of 9 |
| 12 | Tear edge |
| 13 | Conveyor belt |
| 14a | Motor for 13 |
| 14b | Drive belt for 13 |
| 15 | Storage table |
| 16a | Motor for 15 |
| 16b | Driving linkage for 19 |
| 17 | Roller for 15 |
| 18 | Toothed strip attached to 15 |
| 19 | Toothed wheel engages with 18 |
| 20 | Chain belt |
| 21a | Motor for 22 |

-continued

| List of Reference Symbols | |
|---|---|
| 21b | Drive belt for 22 |
| 21c | Rotational axle for 22 |
| 22 | Chopper |
| 23 | Cutting goods |
| 24 | Motor for chain belt |

What is claimed is:

1. An electrically operated disc cutting machine for cutting disks from strand-shaped cutting goods, the disc cutting machine comprising:

a cutting unit including a circular blade mounted in a rotatable manner to a drive housing; with an electric motor mounted to and surrounded by the drive housing, the electric motor configured to power the circular blade; and a horizontal base plate on which the drive housing is installed in a cantilevered manner via at least one support column extended in a vertical direction, the base plate configured beneath the cutting unit, the at least one support column connected between the drive housing and the base plate defining a continuous intermediate space disposed in a horizontal direction above the base plate and below the electric motor and drive housing, wherein the intermediate space remains open configured for receiving at least one accessory unit for further processing of cut cutting goods; and a second electric motor configured to power the at least one accessory unit, where the second electric motor is accommodated in the drive housing.

2. The disc cutting machine according to claim 1, wherein only one support column extending vertically is provided, the one support column making an L-shape with the base plate.

3. The disc cutting machine according to claim 1, wherein two support columns extending vertically are placed next to each other horizontally.

4. The disc cutting machine according to claim 3, wherein at least one support column exhibits at least one mechanical connection for reversible assembly of an accessory unit.

5. The disc cutting machine according to claim 1, wherein coverings for dust-free covering of unused mechanical connections are provided in the support column.

6. The disc cutting machine according to claim 1, wherein on the drive housing are disposed electronic control elements and/or electrical or mechanical operating elements configured to control the second electric motor.

7. The disc cutting machine according to claim 1, wherein an accessory unit comprises a foil roll, from which foil for takeup of cut disks of cutting goods can be guided in the intermediate space between the drive housing and the base plate with a pivot bearing of the foil roll provided in one of the support columns.

8. The disc cutting machine according to claim 7, on the support column or outside on the drive housing, a cutting unit is placed for cutting of foil pieces or a tear edge for tearing off pieces of foil.

9. The disc cutting machine according to claim 1, wherein an accessory unit comprises a conveyor belt for transport of cut discs of cutting goods through the intermediate space between the drive housing and the base plate, with the drive mechanism for the conveyor belt accommodated in the drive housing.

10. The disc cutting machine according to claim 1, wherein an accessory unit comprises a storage table especially bent into an L shape, to admit cut disks of cutting goods in the intermediate space between the drive housing and the base plate, the storage table including a drive mechanism for the storage table being accommodated in the drive housing.

11. The disc cutting machine according to claim 10, further comprising a storage table having a toothed strip therein engaging with a driven toothed wheel.

12. The disc cutting machine according to claim 1, further comprising the at least one accessory unit disposed within the continuous intermediate space.

13. The disc cutting machine according to claim 12, further comprising a drive mechanism disposed within the drive housing, the drive mechanism configured for driving the at least one accessory unit.

14. The disk cutting machine according to claim 13, including a chain belt configured to lift the cut cutting goods off the circular blade and a separating mechanism configured to separate the cut cutting goods from the chain belt.

15. The disk cutting machine according to claim 14, wherein a motor for driving the separating mechanism is disposed within the drive housing.

16. The disk cutting machine according to claim 1, further comprising a ventilation device is in order that, at least during operation of the disk cutting machine a cooling air flow can be generated that enters through an inlet opening into the drive housing, the air flow being guided passes by an electric motor and emerging back out from the drive housing through an outlet opening.

17. The disc cutting machine according to claim 16, wherein the ventilation device is placed in one of the support columns.

18. The disk cutting machine according to claim 17, wherein the ventilation device comprises a locking device when the electric motor is turned off, closes the outlet opening of the ventilation device at least to seal against water spray, and when the electric motor is switched on, the locking device keeps the outlet opening for the exiting cooling air flow, with operation of the locking device linked to operation of an on-off switch.

19. The disk cutting machine according to claim 18, wherein the ventilation device geometrically configured in order that the cooling air flow moves in the drive housing from the bottom upwards, with the outlet opening placed above the inlet opening.

* * * * *